US005469899A

United States Patent [19]

Nish

[11] Patent Number: 5,469,899

[45] Date of Patent: Nov. 28, 1995

[54] STABILIZATION OF CANS WITH A SMALLER FOOTPRINT ON A CAN ELEVATING PLATFORM OF AUTOMATIC BEVERAGE FILLING MACHINERY

[75] Inventor: Terry E. Nish, Salt Lake City, Utah

[73] Assignee: Servi-Tech Inc., Salt Lake City, Utah

[21] Appl. No.: 189,956

[22] Filed: Jan. 31, 1994

[51] Int. Cl.[6] ..... B67C 3/26; B67C 3/34

[52] U.S. Cl. ..... 141/275; 141/148; 141/152; 141/172; 53/317

[58] Field of Search ..... 141/275–278, 141/140, 144–152, 172, 371, 39; 53/317, 318; 198/346.2, 468.8; 403/13, 260, 256

[56] References Cited

U.S. PATENT DOCUMENTS 2,145,765 1/1939 Huntley et al. ..... 141/150
2,656,964 10/1953 Detrez ..... 141/172
2,896,676 7/1959 Minard ..... 141/146
3,172,434 3/1965 Boucher ..... 141/172
3,245,436 4/1966 Burgert, Jr. ..... 141/172

*Primary Examiner*—Henry J. Recla
*Assistant Examiner*—Steven O. Douglas
*Attorney, Agent, or Firm*—Foster & Foster; Lynn G. Foster

[57] ABSTRACT

Stirrup and can elevating platform components are disclosed which, in normal operation, do not tilt or mis-align smaller footprint cans as the cans are successively transferred to and elevated by a can platform or a wear plate superimposed upon the can platform prior to and during filling.

6 Claims, 3 Drawing Sheets

STABILIZATION OF CANS WITH A SMALLER FOOTPRINT ON A CAN ELEVATING PLATFORM OF AUTOMATIC BEVERAGE FILLING MACHINERY

FIELD OF INVENTION

The present invention relates generally to can elevating platforms in automatic beverage filling equipment and more particularly to stabilization of smaller footprint cans by use of modified can elevating platforms and/or platform wear plates in automatic beverage filling equipment.

BACKGROUND

Can elevating platform assemblies have been used for decades in beverage filling machinery. These can elevating platform assemblies comprise a piston rod extending from a cylinder to which a can platform is non-rotatably mounted using two countersunk screws. Ordinarily, an apertured platform wear plate is superimposed contiguously over the platform and the countersunk screws pass through countersunk apertures in the wear plate as well. A stirrup shoe or contoured centering guide is superimposed upon the top of the wear plate (or platform, if no wear plate is used) against which successive cans are rapidly displaced during the filling process, just prior to upward displacement of the piston rod.

The beverage filling equipment described above was designed for and worked well with metal cans having a relatively broad bottom base or footprint. However, the beverage industry, to save on the quantity of metal, including aluminum, used per can, has progressively reduced the size of the footprint of the can. Through a series of reductions, the diameter of the footprint has gone from 2.600 inches in a size 211 can to 1.875 inches in a size 202 can, which are currently being used.

Accordingly, the inherent stability of the can during the filling process has been reduced, especially in lightweight aluminum cans and the ease with which the stability of this smaller footprint can is disrupted has greatly increased. As a consequence, the smaller footprint can, using the older can platform assembly, has been found to de-stabilize as and after as it is shifted across and onto the top apertured surface, as the case may be, resulting in significant damage to the can, filler seal, and packaged cans, frequently requiring significant down time for the beverage filling machinery. The can tends to rock as and after it crosses the top apertured surface. Also, when engaging the standard stirrup, the smaller footprint can, especially when formed of lightweight material, tends to tip. Thus, the can may be cocked or misaligned as it enters the fill valve, which can cut the sealing gasket causing machinery and production line down time.

It is possible under these conditions to bend or knock down the flange of the can. This situation in turn can cause a mismatch with the lid during the seaming process, causing a leaker, which may be detected as a low fill, or it may get into the finished goods in the warehouse causing expensive damage by leaking at that point. These situations can result in a non-seal between the can and the valve or can sealing gasket during the filling process, resulting in low or non-fill can coming off the filler. This in turn, can cause jam-ups on the transfer or in the can seamer during the seaming process, due to their light weight and because of the speed these machines run. Again, causing expensive production line down time, to clear the down cans on the transfer or clear out the cans jammed in the seamer.

At the discharge, if the can does not get a nice smooth transfer and is shaken or rocked, it can result in a low fill can, resulting from spillage, or it can cause foaming between the filler and seamer on the transfer, again resulting in a low filled can. Both situations are expensive in lost product, cans, lids, and production line down time.

BRIEF SUMMARY AND OBJECTS OF THE PRESENT INVENTION

In brief summary, the present invention overcomes or substantially alleviates the problems of the prior art mentioned above. Components for can elevating platform assemblies are provided which, in normal operation, do not de-stabilize the smaller footprint cans as the cans are successively transferred to a can platform or a wear plate superimposed upon the can platform prior to and during filling. A quick, inexpensive and effective solution to the small footprint can instability problem is provided.

With the foregoing in mind, it is a primary object of the present invention to provide novel can elevating platform assemblies, and related methods, which provide for improved stability of small footprint cans during the filling process.

It is a further dominant object of the present invention to provide can elevating platforms in automatic beverage filling equipment comprising at least one can stability enhancing component.

An additional paramount object of the present invention is the provision in automatic beverage filling machinery of novel features in a can elevating platform by which can stability is enhanced during filling.

A further important object of the present invention is the provision of improvements in can elevating platform assemblies that enhance can stability and thereby reduce the likelihood of damage to the cans, the sealing gaskets, and to packaged cans thus reducing down time for the beverage filling machinery.

A further valuable object of the present invention is the provision of a novel can-receiving platform and/or platform wear plate by which the stability of small footprint cans is enhanced immediately prior to and during filling.

An additional significant object is the provision of a novel, stability enhancing stirrup in a can elevating platform assembly of automatic beverage filling machinery.

An additional dominant object of the present invention is to provide a quick, inexpensive, and effective solution to small footprint can instabilty just before and at the time of filling.

These and other objects and features of the present invention will be apparent from the detailed description taken with reference to the accompanying drawings.

DETAILED DESCRIPTION OF THE ILLUSTRATED EMBODIMENTS

Figure 13:
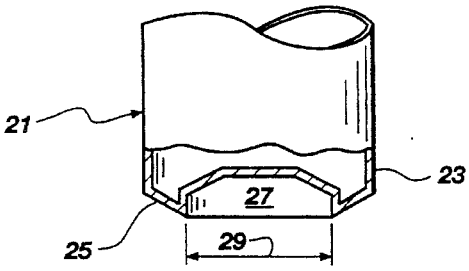
FIG. 13 is an elevational view of the bottom portion of a beverage can.

Reference is now made the drawings wherein like numerals are used to designate like parts throughout. Reference is now made to FIG. 13, which illustrates the lower portion of a typical beverage can generally designated 21. Beverage can 21 comprises a very thin vertical wall 23 and a contoured bottom wall 25, which defines a recess 27. Recess 27 comprises a footprint 29. The footprint 29 has changed over time from 2.600 inches in diameter (for a number 211 can) to 1.875 inches (for a 202 can, currently being the standard in the industry). Specifically, a first can elevating platform assembly, generally designated 20 is illustrated in FIGS. 1–9. As illustrated, the assembly 20 comprises a piston rod 22, which is attached to a can lift cylinder (not shown) of automatic beverage filling machinery, by which the assembly 20 is elevated and lowered to fill a open-top can with beverage in a conventional and well known manner.

The piston rod 22 comprises a reduced diameter distal end 24 having a blunt transversely-directly distal edge 26. Three aligned openings comprising exactly-directed threaded blind bores 28, 30 and 32 are exposed at distal edge 26.

A shoulder 34 exists between the piston rod 22 and the reduced diameter distal end portion 24 of the piston rod, upon which a shim or spacer 36 is placed. Shim 36 is sized and shaped to level the associated can platform.

The assembly 20 further comprises two threaded studs 38, each comprising a threaded base 40 and a smooth, reduced diameter cylindrical portion or pin 42. Threads 40 are sized and shaped so as to accommodate threaded placement in the threaded bores 28 and 32, leaving the smooth cylindrical portion or pin 42 of each extending upwardly above the distal edge 26.

Figure 6:
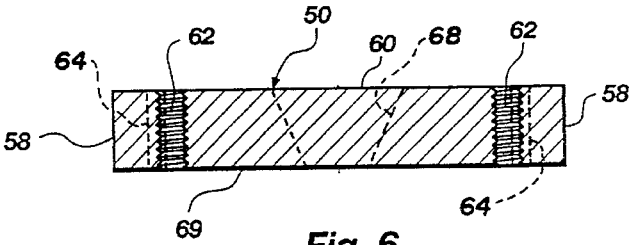
FIG. 6 is an enlarged cross-section taken along lines 6—6 of FIG. 1.

The assembly 20 further comprises a can platform, generally designated 50. Can platform 50 is preferably formed as one-piece from stainless steel and, therefore, comprises a solid body of material, the perimeter of which consists of front edge 52, rear edge 54 and side edges 58. Can platform at 50 further comprises a top smooth flat surface 60 and a bottom flat smooth surface 69, each of which, in the assembled condition, is disposed in a horizontal plane. Bottom surface 69 is disposed in a horizontal plane when the components of assembly 20 are assembled and operative. Surface 60 is interrupted by a pair of threaded bores 62 located near the respective rear corners 63 of can platform 50. The maximum depth of can platform 50, as seen from inspection of FIG. 6, is between surfaces 60 and 69.

Similarly, can platform 50 comprises two countersunk threaded bores 64 one near each opposed front corners 66. Threaded bores 64 are also disposed in a vertical orientation. A single, centrally disposed, relatively large countersunk aperture 68, which receives a relatively large screw fastener 70, accommodates assembling of the can elevating platform assembly 20. Countersunk screw 70 is threaded into blind bore 30 of piston rod 20. It is to be appreciated that while aperture 68 is illustrated as being countersunk, it could, under some circumstances, comprise vertical walls, as will be apparent from the following description.

Figure 7:
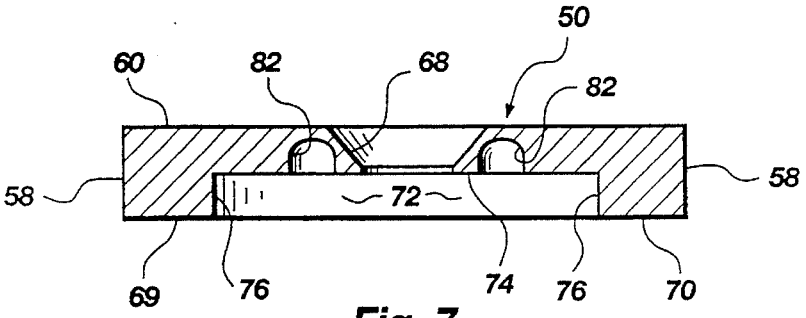
FIG. 7 is an enlarged cross-section taken along lines 7—7 of FIG. 1.
Figure 8:
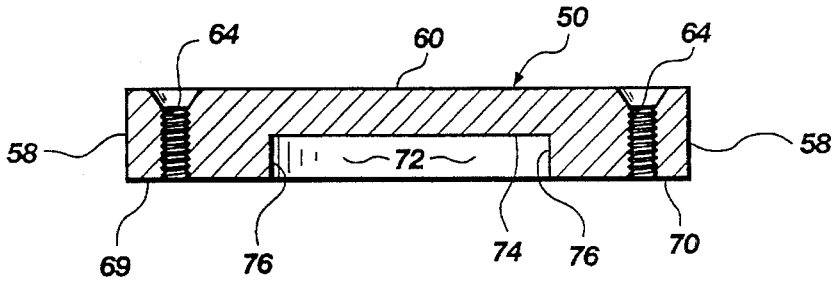
FIG. 8 is an enlarged cross-section taken along lines 8—8 of FIG. 1.
Figure 9:
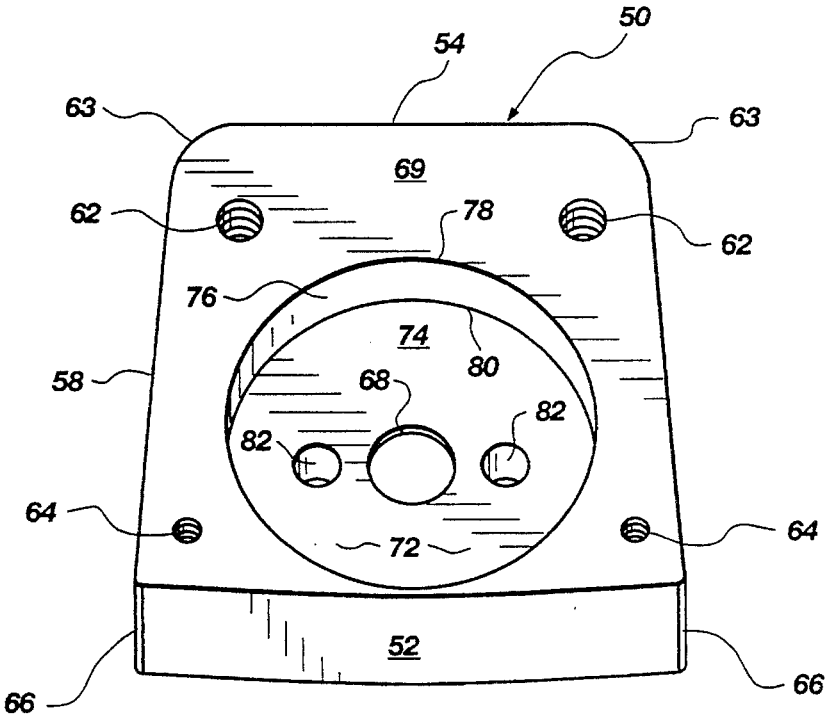
FIG. 9 is an enlarged perspective of the underside of the can platform illustrated in FIG. 1.

Particular reference is now made to FIGS. 7 through 9 which illustrate the underside or bottom region of can platform 50. A central region of the can platform 50, at the underside thereof is machined out to create a cylindrical recess 72. Recess 72 is defined by flat, smooth horizontal base surface 74 and an annular vertically-directed surface 76. Surface 76 intersects surface 69 at ninety degrees at annular corner 78 and surface 74 at ninety degrees at annular corner 80. A relatively large central aperture 68 is located at the diametral center of cylindrical recess 72. Base surface of 74 of recess 72 comprises two aligned smooth blind bores 82, sized and shaped to receive male cylindrical portions or pins 42 to cause the can platform 50 to be properly aligned in its assembled condition and to prevent rotation of the can platform 50 in respect to the piston rod 22.

The assembly 20 further comprises a wear plate, generally designated 90, preferably formed of stainless, hard chrome coated steel. While wear plate 90 is not critically essential, it is preferred normally because it accepts the wear imposed by beverage cans sliding onto and off from the top surface thereof. Conveniently, wear plate 90 after substantial use can be easily replaced without substantial machinery down time, as will be apparent from the following description.

Wear plate 90 comprises a thin metal plate of uniform thickness, formed to fit precisely and contiguously upon surface 60 of can platform 50. Platform 90 comprises a front edge 92, a rear edge 94, and two side edges 96. A relatively large countersunk central bore 98 is vertically disposed in plate 90 and is aligned with and matches bore 68. Where the countersunk head of screw 70 is appropriately flat, only bore 98 needs to be countersunk, meaning that bore 68 may be vertically straight. Where the head of screw 70 has a deeper taper, aperture 98 and part of aperture 68 must comprise a continuous taper adapted to receive the longer taper of the head of screw 70.

Smooth vertically-directed apertures 100 are located near each of the two rear corners of plate 90. Apertures 100 are aligned with and have a diameter compatible with threaded bored 62. Two closely spaced smooth vertically-directed apertures 102 are located in a more central position near rear edge 94, for purposes yet to be explained.

A countersunk aperture 104 is located near each front corner 106. Apertures 106 are smooth and are aligned with threaded bores 64, having a size compatible therewith, when assembly 20 is put together. A countersunk screw 101 is extended through each aperture 104 and threaded into associated threaded bore 64 until the head of each screw 101 is flush with a slightly below surface 91.

Wear plate 90 comprises a top smooth horizontal surface 91 and a bottom smooth horizontal surface 93.

Figure 2:
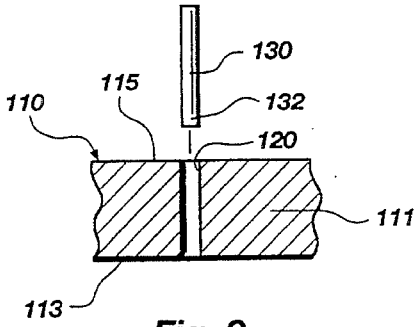
FIG. 2 is an enlarged fragmentary cross-sectional view taken along lines 2—2 of FIG. 1.
Figure 3:
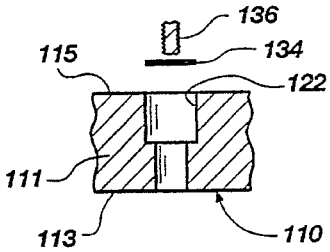
FIG. 3 is an enlarged fragmentary cross-section taken along lines 3—3 of FIG. 1.
Figure 4:
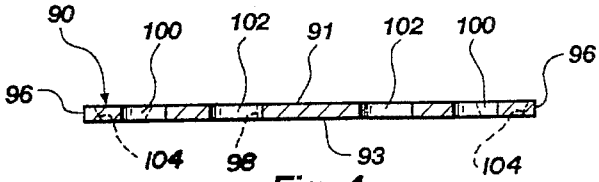
FIG. 4 is an enlarged cross-section taken along lines 4—4 of FIG. 1.
Figure 5:
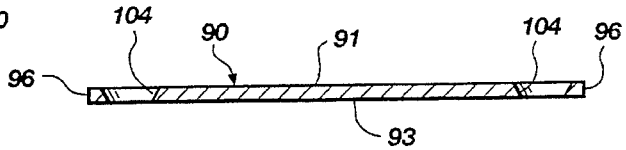
FIG. 5 is an enlarged cross-section taken along lines 5—5 of FIG. 1.

Assembly 20 further comprises a stirrup or stirrup shoe, generally designated 110. Stirrup 110 comprises a horse shoe-shaped component comprising a single body 111, preferably of high impact synthetic resinous material, although stainless steel could be used. Body 11 comprises spaced legs 112 and 114, which define a mouth 116 therebetween, through which cans ingress and egress. Arm 112 is shorter than arm 114. Body 112 also comprises a backrest 118, sized and shaped to continuously receive the cylindrical side wall of each can transferred onto wear plate 90 during the filling process. The backrest area comprises part of a base 119 from which legs 112 and 114 project, the base 119 defining dowel pin-receiving bores 120 and stepped bores 120 located near each base corner 124. One dowel pin bore 120 is best illustrated in FIG. 2, while one stepped bore 122 is best illustrated in FIG. 3.

Stirrup 110 comprises a generally horizontal flat bottom surface 113 and a generally flat horizontal upper surface 115. The overall height of the stirrup 110 is extended a distance greater than is true of a standard stirrup to provide better can stabilization, particularly for light small footprint cans at infeed and discharge.

An oversized steel dowel pin 130 is force-fit through each bore 120 so that the bottom portion 132 of each pin 130 extends into an aligned aperture 102 to in wear plate 90 to insure correct alignment between the wear plate and the stirrup. A flat washer 134 is placed at the base of the larger diameter portion of each stepped bore 122 and a stepped machine screw 136 is extended through each washer 134 and each stepped bore 122, through an aligned aperture 100 in wear plate 90 and threaded into an aligned threaded bore 62 of can platform 50 to assemble the stirrup 110 as part of the can elevating platform assembly 20. The head of each screw 136, when tightened is entirely disposed in the enlarged region of the stepped bore 122 with which it is associated.

Figure 10:
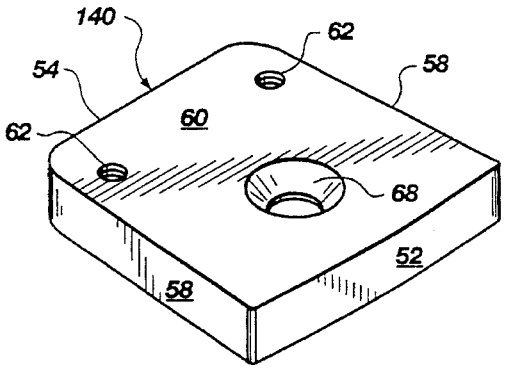
FIG. 10 is a perspective representation of a second can platform embodying the principles of the present invention.
Figure 11:
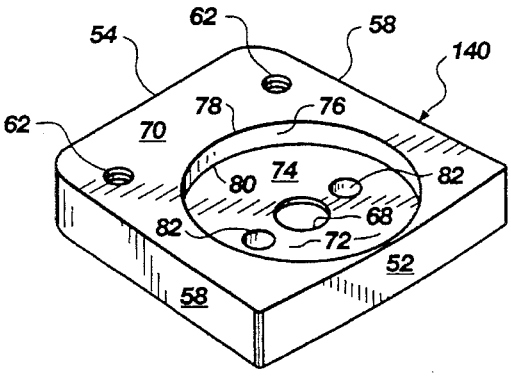
FIG. 11 is a bottom perspective representation of the can platform of FIG. 10.

Reference is now made to the can-elevating platform embodiment illustrated in FIGS. 10 and 11, which shows a can platform, generally designated 140. In certain major respects can platform 140 has structural features identical to features of previously described can platform 50. These structural features have been correspondingly enumerated in FIGS. 10 and 11 and no further description thereof is deemed necessary. Can platform 140 may be used in lieu of both previously described wear plate 90 and can platform 50. Accordingly, the vertical dimension of can platform 140 ordinarily will be the same as the sum of the vertical dimensions of can platform 50 and wear plate 90. Because, using can platform 140, wear plate 90 is eliminated, at least the top region of can platform 140 should be made of extremely hard metal compatible with beverage processing standards, such as stainless steel coated with hard chrome.

To convert an existing can elevating platform assembly from the prior art to the present invention, a technician would simply disassemble the prior art can elevating platform assembly, remove the prior art wear plate and the prior art can platform (if both comprise the prior art can platform) or, where no prior art wear plate comprises the prior art assembly, and insert single can platform 140. The prior art piston rod is equipped with only threaded blind bores 28 and 32. Therefore, a central blind bore 30 must be formed, using known drilling and tapping techniques, and stabilizing and aligning threaded plugs 38 placed in threaded bore 28 and 32 prior to assembly of the modified can elevating platform assembly using can platform 140.

Figure 1:
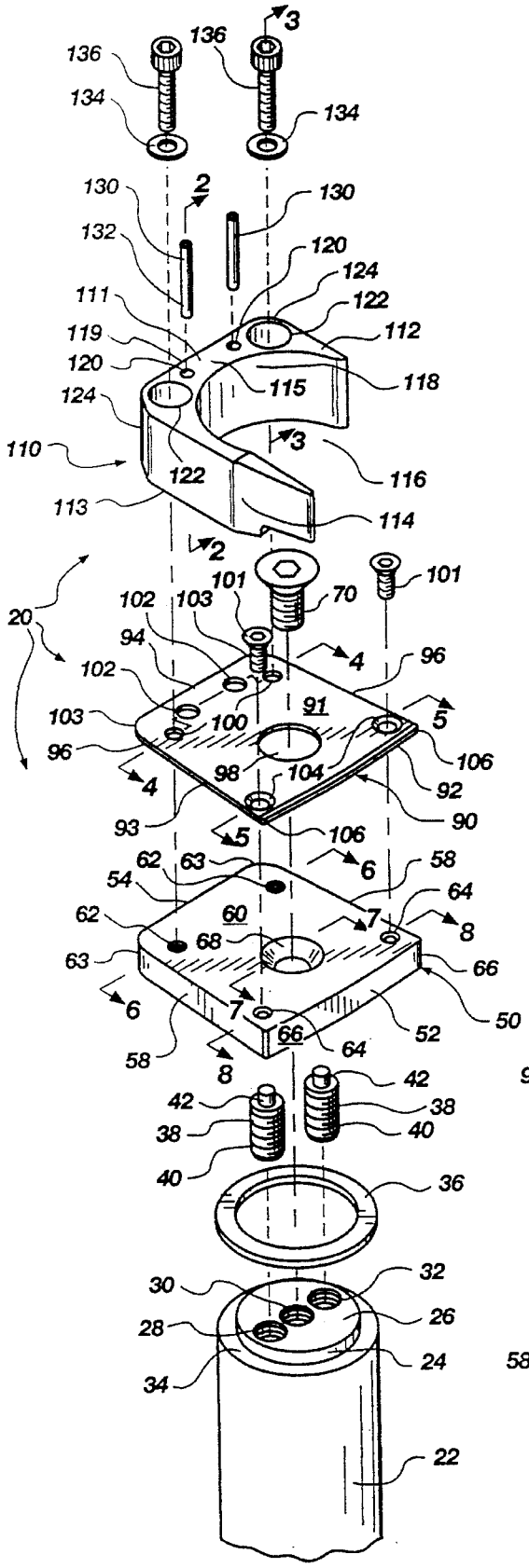
FIG. 1 is an exploded perspective of one novel can elevating platform assembly in accordance with the present invention.

In lieu thereof, following disassembly and removal of the prior art can platform and wear plate, if any, together with the prior art stirrup, the assembly illustrated in and in described in conjunction with FIG. 1 may be substituted.

In either event, the downtime for the beverage filling machinery is minimized during the conversion or replacement.

Figure 12:
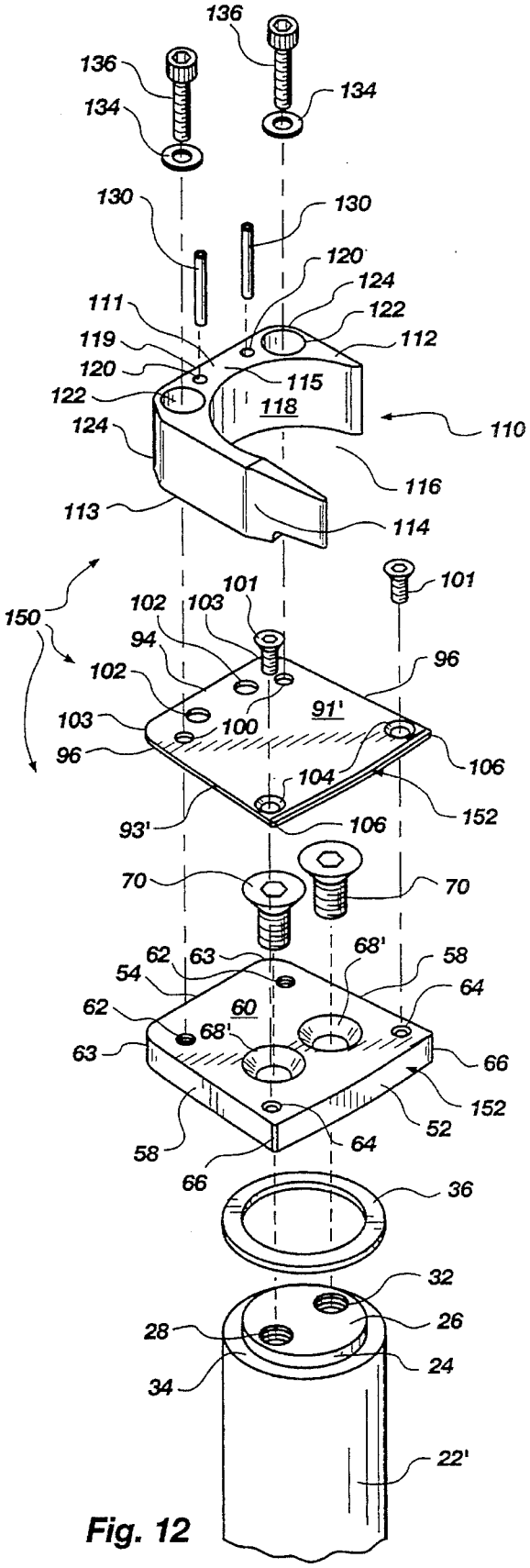
FIG. 12 is an exploded perspective of a third can elevating platform assembly in accordance with the principles of the present invention.

A third embodiment of the present invention is illustrated in FIG. 12 and comprises a can elevating platform assembly, generally designated 150. Assembly 150 is illustrated as comprising stirrup 110, fully described above. Accordingly no further description of the stirrup is needed. The assembly 150 also comprises previously described dowel pins 130, washers 134 and screws 136.

The assembly 150 also comprises piston rod 22', which is identical to piston rod 22 heretofore described except that threaded bore 30 does not comprise part of piston rod 22'. The assembly 150 also excludes threaded studs 38.

The assembly 150 comprises a conventional prior art can platform, generally designated 152. Can platform 152 comprises two side-by-side relatively large, centrally disposed countersunk apertures 68'. The structural features of can platform 152 which are identical to structural features of previously described can platform 50 have been correspondingly enumerated and no further description is deemed needed.

The can platform 152 is secured at the distal end of piston rod 22' by inserting a countersunk screw 70 through each hole 68' and respectively threading the same into threaded bores 28 and 32 of the piston rod 22'.

Assembly 150 also comprises a wear plate, generally designated 152. The wear plate 152 is of uniform thickness and possesses a substantial number of the structural features also comprising previously described wear plate 90. To the extent the structural features of wear plate 152 are the same of those of wear plate 90, those features have been correspondingly enumerated and no further description thereof is deemed necessary. Wear plate 150 is distinguished from wear plate 90 by reason of the fact that top and bottom surfaces 91' and 93' of wear plate 150 are not interrupted by a relatively large central aperture, but has no centrally-disposed aperture of any type.

Countersunk screws 101 are extended through apertures 104 in plate 152 and threaded into threaded bores 64 of can platform 152 to secure the two components together. When the screws 101 are tightened, the top surface of each is either flush with or slightly below surface 91'.

Thus, the can filling instability problem described above can be substantially solved by disassembling an existing prior art can elevating platform assembly excluding the connections between piston rod 22' and can platform 152, removing the old prior art wear plate, replacing the prior art wear plate with wear plate 152 and reassembling earlier disassembled portion of the can elevating platform assembly, modified as described, for immediate operational resumption of the beverage filling production line. Thus, the prior art stirrup may be retained, if desired. In lieu thereof, stirrup 110 may be substituted for the prior art stirrup during reassembly of the modified can elevating platform assembly.

The invention may be embodied in other specific forms without departing from the spirit of essential characteristics thereof. The present embodiments therefore to be considered in all respects as illustrative and are not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A can elevating platform assembly for automatic beverage filling equipment comprising:

platform structure comprising a lower platform and an upper wear plate comprising a can receiving top surface, the upper wear plate and the lower platform each comprising only one piston rod fastener receiving aperture, the two apertures being aligned;

stirrup structure superimposed upon the top surface and non-rotatably joined to the platform structure;

a piston rod for elevating and lowering the platform structure and the stirrup to successively fill cans, the piston rod being non-rotatably joined to the platform structure, the end of the piston rod connected to the platform structure comprising three thread bores, one threaded blind bore being aligned with the aligned apertures of the upper wear plate and the lower platform, and wherein the underside of the lower platform comprises two blind bores aligned respectively with the other two blind bores, fasteners, extending between the respectively aligned blind bores and threaded blind bores to prevent rotation of the platform structure;

the top surface of the platform structure comprising no more than one exposed aperture therein for receiving no more than one fastener extending through the platform structure and into the piston rod whereby the stability of small footprint cans is enhanced.

2. An automatic beverage filling machine comprising a lift mechanism for a container having a diametrally reduced footprint comprising:

a reciprocable piston rod comprising a distal end comprising at least two fastener-receiving sites;

a platform comprising an underside, an upper surface comprising a central container footprint-receiving area, and fastener-receiving sites, at least two of said platform fastener-receiving sites being aligned with two of said piston rod fastener-receiving sites;

at least two fasteners extending between pairs of said aligned fastener-receiving sites thereby non-rotatably releasibly connecting the distal end of the piston rod to the underside of the platform generally in direct vertical relation;

a separate flat wear plate comprising a top surface and a bottom surface which is contiguously superimposed in direct vertical relation upon the upper surface of the platform, the wear plate further comprising a plurality of apertures through which fasteners pass, no more than one platform-to-piston rod fastener accommodating aperture being centrally located within the footprint receiving area;

a container-centering stirrup comprising fastener-receiving sites through which fasteners pass non-rotatably connecting the stirrup to the platform in eccentric vertical relation so that a lower surface of the stirrup contiguously engages the top surface of the wear plate outside the footprint-receiving area.

3. An automatic beverage filling machine according to claim 2 wherein the wear plate has one aperture centrally disposed within the footprint receiving area.

4. An automatic beverage filling machine according to claim 2 wherein the fastener-receiving sites at the distal end of the piston rod comprise three threaded bores, only one of which is accessible through the wear plate and the platform.

5. An automatic beverage filling machine according to claim 2 wherein the fastener-receiving sites at the distal end of the piston rod comprise at least two threaded bores both of which are accessible through the platform and neither of which is accessible through the wear plate.

6. An automatic beverage filling machine according to claim 2 wherein threaded fasteners extend through the stirrup, the wear plate, and into threaded bores comprising some of the fastener-receiving sites of the platform, the threaded bores being exposed at the upper surface of the platform.

* * * * *